US008419889B2

(12) United States Patent
Smith

(10) Patent No.: US 8,419,889 B2
(45) Date of Patent: Apr. 16, 2013

(54) ULTRASECURE CARD PACKAGE

(75) Inventor: Dennis R. Smith, Minnetonka, MN (US)

(73) Assignee: CPI Card Group—Colorado, Inc., Littleton, CO (US)

( * ) Notice: Subject to any disclaimer, the term of this patent is extended or adjusted under 35 U.S.C. 154(b) by 0 days.

(21) Appl. No.: 13/083,178

(22) Filed: Apr. 8, 2011

(65) Prior Publication Data

US 2011/0203722 A1 Aug. 25, 2011

Related U.S. Application Data

(63) Continuation of application No. 12/017,227, filed on Jan. 21, 2008, now abandoned.

(51) Int. Cl.

| | |
|---|---|
| ***C09J 5/04*** | (2006.01) |
| ***C09J 5/06*** | (2006.01) |
| ***B29C 65/52*** | (2006.01) |
| ***B32B 37/02*** | (2006.01) |
| ***B32B 37/06*** | (2006.01) |
| ***B32B 38/16*** | (2006.01) |
| *B32B 37/10* | (2006.01) |
| *B32B 38/14* | (2006.01) |

(52) U.S. Cl.
USPC ..... 156/307.5; 156/277; 156/297; 156/306.6; 156/322

(58) Field of Classification Search ..... 156/277, 156/297, 306.6, 307.5, 322
See application file for complete search history.

(56) References Cited

U.S. PATENT DOCUMENTS

| | | | | |
|---|---|---|---|---|
| 3,498,018 | A | 3/1970 | Seiferth et al. | |
| 3,939,625 | A * | 2/1976 | Remele et al. | 53/131.3 |
| 4,226,658 | A * | 10/1980 | Carlson et al. | 156/247 |
| 4,544,590 | A | 10/1985 | Egan | |
| 4,650,079 | A | 3/1987 | Tani | |
| 4,824,498 | A * | 4/1989 | Goodwin et al. | 156/71 |
| 5,000,810 | A * | 3/1991 | Silverstein | 156/238 |
| 5,091,261 | A | 2/1992 | Casey et al. | |
| 5,257,491 | A | 11/1993 | Rouyer et al. | |
| 5,360,116 | A | 11/1994 | Schmiletzky | |
| 5,427,832 | A | 6/1995 | Longtin | |
| 5,438,928 | A * | 8/1995 | Chatwin et al. | 101/369 |
| 5,760,381 | A | 6/1998 | Stich et al. | |
| 5,777,305 | A | 7/1998 | Smith et al. | |
| 5,804,026 | A * | 9/1998 | Vogt | 156/295 |
| 5,918,909 | A | 7/1999 | Fiala et al. | |
| 6,010,784 | A | 1/2000 | Peterson | |
| 6,109,439 | A | 8/2000 | Goade, Sr. | |
| 6,224,108 | B1 | 5/2001 | Klure | |
| 6,270,012 | B1 | 8/2001 | Dawson | |
| 6,315,206 | B1 | 11/2001 | Hansen et al. | |
| 6,328,341 | B2 | 12/2001 | Klure | |
| 6,439,613 | B2 | 8/2002 | Klure | |
| 6,454,165 | B1 | 9/2002 | Dawson | |

(Continued)

OTHER PUBLICATIONS

"Roll Coating"—Modern Plastics Encyclopedia—1984, p. 198.*

*Primary Examiner* — Sonya Mazumdar
(74) *Attorney, Agent, or Firm* — Marsh Fischmann & Breyfogle LLP

(57) ABSTRACT

A package for securing a card is disclosed where the card is retained between two panels that are secured together by a heat-activated adhesives and/or a combination of polymeric and adhesive constituents to drastically hinder surreptitious access to the contents of the package. The package may include additional features for activating or accessing the card and increasing the aesthetic appeal of the package.

30 Claims, 4 Drawing Sheets

U.S. PATENT DOCUMENTS

| | | | | |
|---|---|---|---|---|
| 6,543,809 | B1 | 4/2003 | Kistner et al. | |
| 6,619,480 | B2 | 9/2003 | Smith | |
| 6,640,974 | B2 | 11/2003 | Malone | |
| 6,715,795 | B2 | 4/2004 | Klure | |
| 6,845,863 | B1 | 1/2005 | Riley | |
| 6,957,737 | B1 | 10/2005 | Frederickson et al. | |
| 7,000,844 | B1 | 2/2006 | Smith | |
| 7,017,946 | B2 * | 3/2006 | Behnen | 283/61 |
| 7,267,284 | B1 | 9/2007 | Smith | |
| 7,326,315 | B2 * | 2/2008 | Behnen | 156/253 |
| 7,824,029 | B2 * | 11/2010 | Jones et al. | 347/101 |
| 2005/0091115 | A1 | 4/2005 | Arthur | |
| 2005/0279825 | A1 | 12/2005 | Ashby et al. | |
| 2006/0261154 | A1 | 11/2006 | Arthur et al. | |
| 2007/0278296 | A1 | 12/2007 | Dwyre et al. | |
| 2009/0078590 | A1 | 3/2009 | Smith | |

* cited by examiner

ULTRASECURE CARD PACKAGE

RELATED APPLICATIONS

This is a continuation of U.S. patent application Ser. No. 12/017,227, filed Jan. 21, 2008, entitled "ULTRASECURE CARD PACKAGE", the entirety of which is hereby incorporated by reference.

BACKGROUND OF THE INVENTION

The present invention relates generally to secure point-of-sale activated cards, and more particularly, to packaging technology designed to deter theft and unaccountable activation of activatable point of sale cards.

The purchase, sale, and use of cards such as debit cards, gift cards, credit cards, telephone cards and the like has dramatically increased to the point where the cards are well known and their uses are widely recognized. At times, cards are printed and issued with a predetermined balance and typically sold as a retail item. However, a typical card is often stored or displayed in an inactivated state to reduce the risk of theft. This essentially renders the card valueless until it is activated by a retailer or another party upon purchase by the end user. Despite these security features, point of sale cards are still stolen, often by removing the card from its packaging. At other times, the theft can be more surreptitious. For example, the would-be thief may only remove a card from its packaging long enough to obtain identifying card data such as an account number or a PIN number, after which the card is returned to its packaging. In some instances, this information may be accessible without removing the card from the packaging. The thief can then wait until the card is activated and at that time gain unauthorized access to any value associated with the card.

In addition to cards, suppliers and/or retailers often desire to include additional material or information within the card packaging. For example, a card supplier will often include a set of terms and conditions of use or instructions for using the card on a separate sheet of paper. Although these inserts can be bulky, such as when multiple sheets or folded sheets of material must be included, it is desirable to include them inside the package with the card to prevent their loss and maintain a clean package appearance.

Packaging with enhanced security that is capable of indicating unauthorized access to a packaged card reduces shrinkage due to theft of card value. As cards become more widely used internationally, new challenges arise that call for new solutions.

SUMMARY OF THE INVENTION

One embodiment in accordance with the invention includes a secure card package with a first panel having an outer surface and an inner surface and a second panel having an outer surface and an inner surface. In this embodiment the inner surfaces of the panels face toward each other. There is a polymeric coating on the inner surfaces of the panels and an adhesive over the polymeric coating. A card is located between the first and second panels and the first and second panels are heated under pressure to activate the adhesive in a region substantially surrounding the card to card to enclose the card between the panels. The polymeric coating and adhesive could cover substantially all of the inners surfaces of the panel, the region substantially surrounding the card, or any other region as desired.

Another embodiment in accordance with the invention includes a secure card package with a first panel having an outer surface and an inner surface and a second panel having an outer surface and an inner surface. In this embodiment the inner surfaces of the panels face toward each other. There is a polymeric coating on the inner surfaces of the panels and an adhesive over the polymeric coating. A card is located between the first and second panels and the first and second panels are heated under pressure to activate the adhesive in a region substantially surrounding the card to card to enclose the card between the panels. In this embodiment at least one of the panels has a line of separation which upon separation defines a slot in the panel and provides access to the space between the panels. In some embodiments, the slot is dimensioned to allow passage of the card. In another embodiment one of the panels has a removable portion, and a line of separation defines the perimeter of the removable portion. In some embodiments having the removable portion, there is an adhesive on the removable portion for holding a card disposed within the space between the first and second panels.

Another embodiment in accordance with the invention includes a secure card package with a first panel having an outer surface and an inner surface and a second panel having an outer surface and an inner surface. in this embodiment the inner surfaces of the panels face toward each other. There is a polymeric coating on the inner surfaces of the panels and an adhesive over the polymeric coating. A card is located between the first and second panels and the first and second panels are heated under pressure to activate the adhesive in a region substantially surrounding the card to card to enclose the card between the panels. In this embodiment one of the panels has an aperture. The card has a data field disposed and is disposed such that at least a portion of the data field is viewable through the aperture in the panel.

Another embodiment in accordance with the invention includes a secure card package with a first panel having an outer surface and an inner surface and a second panel having an outer surface and an inner surface. In this embodiment the inner surfaces of the panels face toward each other. There is a polymeric coating on the inner surfaces of the panels and an adhesive over the polymeric coating. A card is located between the first and second panels and the first and second panels are heated under pressure to activate the adhesive in a region substantially surrounding the card to card to enclose the card between the panels. The polymeric coating of this embodiment includes low density polyethylene, linear low density polyethlyene, high density polyethlene and/or copolymers of polyethylene.

Another embodiment in accordance with the invention includes a secure card package with a first panel having an outer surface and an inner surface and a second panel having an outer surface and an inner surface. In this embodiment the inner surfaces of the panels face toward each other. There is a polymeric coating on the inner surfaces of the panels and an adhesive over the polymeric coating. A card is located between the first and second panels and the first and second panels are heated under pressure to activate the adhesive in a region substantially surrounding the card to card to enclose the card between the panels. The adhesive of this embodiment includes ethylene vinyl acetate.

Another embodiment in accordance with the invention involves a method of forming a secure card package. The method includes the steps of applying a polymeric coating to a surface of a first panel and a surface of a second panel and applying an adhesive over the polymeric coating on the panels. A card is positioned between the panels, with the coated surfaces of the panels facing toward each other and toward the card. The region of the panels around the card is pressed together and heated to activate the adhesive. In some embodiments of this method, an activation data field is placed on the card. Some embodiments may include inserting the card into a metalized sleeve.

In another embodiment in accordance with the invention, a secure card package has a card with a first panel and a second panel enclosing the card. There is a laminated layer bonding the two panels together in a region around the card. The laminated layer has a first polymer layer adjacent the first panel, a second polymer layer adjacent the second panel, and an adhesive layer between the first and second polymer layers. In some embodiments, the card may have an activation field.

In yet another embodiment in accordance with the invention, a secure card package has a card with a first panel and a second panel enclosing the card. There is a laminated layer bonding the two panels together in a region around the card. The laminated layer has a first polymer layer adjacent the first panel, a second polymer layer adjacent the second panel, and an adhesive layer between the first and second polymer layers. In some embodiments, the card may have an activation field. This embodiment has a third panel that is joined to edge-to-edge with the first panel. The third panel is adapted to move through a range of motion. The third panel may be moved to a first position wherein the third panel at least partially covers the first panel. The first panel is disposed between the second and third panels when in this first position. The third panel may also be moved into a second position where the third panel at least partially covers the second panel. The second panel is disposed between the first and third panels when in this second position. It is possible, but not necessary, to construct this embodiment from a sheet of material having a first fold line and a second fold line, wherein the first, second, and third panels are formed on the sheet with the first and second panels joined at the first fold line and the first and third panels joined at the second fold line.

In another embodiment in accordance with the invention, a secure card package has a card with a first panel and a second panel enclosing the card. There is a laminated layer bonding the two panels together in a region around the card. The laminated layer has a first polymer layer adjacent the first panel, a second polymer layer adjacent the second panel, and an adhesive layer between the first and second polymer layers. In some embodiments, the card may have an activation field. This embodiment has a third panel that is joined to edge-to-edge with the first panel. The third panel is adapted to move through a range of motion. The third panel may be moved to a first position wherein the third panel at least partially covers the first panel. The first panel is disposed between the second and third panels when in this first position. In some cases, an aperture on the first panel may be covered by the third panel in this position. The third panel may also be moved into a second position where the third panel at least partially covers the second panel. The second panel is disposed between the first and third panels when in this second position. In this embodiment the first panel has an aperture, the card has a data field on it, and the card is disposed such that the data field is viewable through the aperture.

In another embodiment in accordance with the invention a secure card package includes a first panel having an outer surface and an inner surface and a second panel having an outer surface and an inner surface. In this embodiment, the inner surfaces of the panels face toward each other. A heat activated adhesive is printed on the inner surface of the first panel. A card is disposed between the first and second panels. The first and second panels are heated under pressure to activate the adhesive in a region substantially surrounding the card to enclose the card between the panels.

In another embodiment in accordance with the invention a secure card package includes a first panel having an outer surface and an inner surface and a second panel having an outer surface and an inner surface. In this embodiment, the inner surfaces of the panels face toward each other. A heat activated adhesive is printed on the inner surface of the first panel using a printing roller, a flood coater, a Gravure press, a multi-roll printing system, or an Anilox roll system. A card is disposed between the first and second panels. The first and second panels are heated under pressure to activate the adhesive in a region substantially surrounding the card to card to enclose the card between the panels.

In another embodiment in accordance with the invention a secure card package includes a first panel having an outer surface and an inner surface and a second panel having an outer surface and an inner surface. In this embodiment, the inner surfaces of the panels face toward each other. A heat activated adhesive is printed on the inner surface of the first panel in a region substantially surrounding the card. A card is disposed between the first and second panels. The first and second panels are heated under pressure to activate the adhesive in a region substantially surrounding the card to enclose the card between the panels.

DETAILED DESCRIPTION

Figure 1:
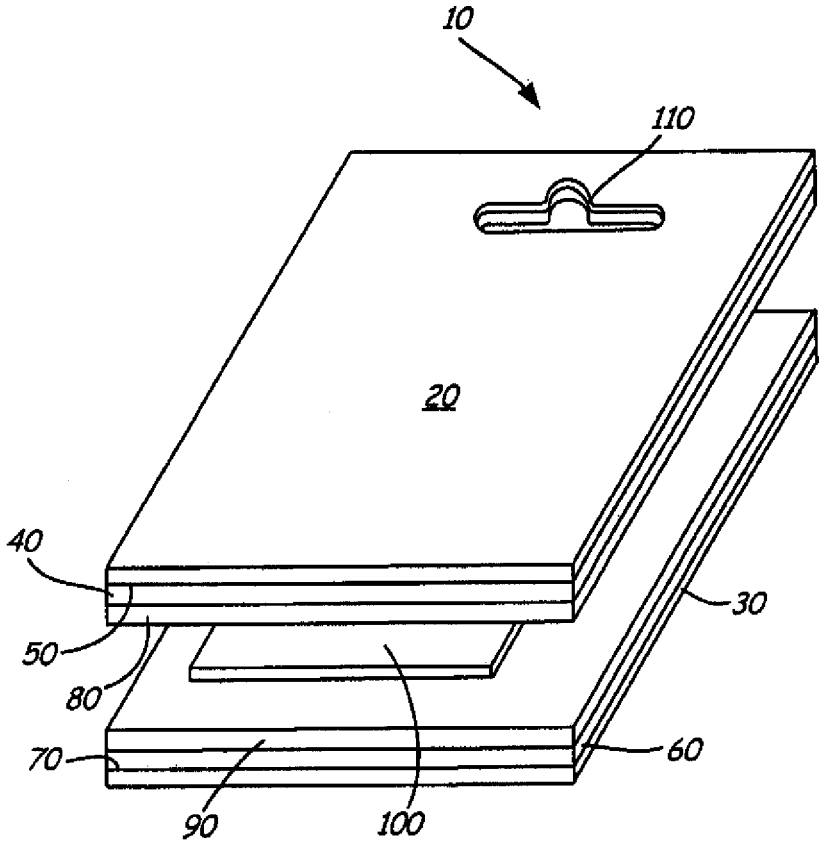
FIG. 1 is a perspective exploded view of a secure card package in accordance with embodiments of the invention.

The following detailed description should be read with reference to the drawings, in which like elements in different drawings are numbered identically. The drawings depict selected embodiments and are not intended to limit the scope of the invention. It will be understood that embodiments shown in the drawings and described below are merely for illustrative purposes, may not be to scale, and are not intended to limit the scope of the invention as defined in the claims.

FIG. 1 is a perspective exploded view of a secure card package in accordance with embodiments of the invention. The package 10 includes a first panel 20 and a second panel 30. The first panel has a polymeric coating 40 disposed on the inner surface 50 of the panel 20. The second panel 30 also has a polymeric coating 60 on its inner surface 70. An adhesive 80 is disposed over the polymeric coating 40 on the first panel, and an adhesive 90 is disposed over the polymeric coating 60 that is disposed on the second panel. In FIG. 1, adhesive is shown as being disposed initially on both panels. For ease of manufacturing this might be a typical case, but the adhesive could also be disposed on only one of the panels prior to enclosing the card. An aperture 110 may be formed through all of the layers to allow for hanging the package on a display rack.

A card 100 is disposed between the first and second panels. The card could be a point of sale activated phone or gift card, a credit or debit card, or any type of stored value card or other card where security of the card is an issue. The package may also include documentation as to how to use the card or redeem card value as well as terms and conditions regarding the card agreement or other documentation (not shown). This documentation may make the material stored in the card somewhat bulky, so a polymer and adhesive combination that securely fastens the panels despite the pressure exerted by the sometimes bulky enclosed components is used.

The panels themselves may be made of any suitable material. One exemplary material is a bleached paperboard substrate used in packaging of foods and other products. Such panels may be clay coated and/or otherwise treated on the outer surface to improve printability, smoothness, and other desired characteristics.

The polymeric coating is applied to the inner surfaces of the panel, which may be uncoated. The polymeric coating may be applied to essentially the entire inner surface of the panel, or to selected areas or regions depending on the application. The polymer layer may be a polyolefin, and polyolefins known to effectively work with embodiments of the invention include low density polyethylene (LOPE), linear low density polyethlyene (LLDPE), high density polyethlene (HDPE) and copolymers of polyethylene (PE).

The adhesive may be applied over the polymeric coating. An ethylene vinyl acetate has been found to be effective, as have laminating adhesives based on polyurethane, but other adhesives such a ethylene methyl acrylate, and other acrylic copolymer adhesives are also contemplated. The adhesive may include additives that improve adhesive performance or otherwise improve the performance of the packaging.

The combination of a polymeric layer with the adhesive layer may have several benefits such as a thinner and lighter adhesive layer due to the synergistic relationship between the two layers. Also, because adhesive is typically more expensive than the polymeric layer, the use of less adhesive or a substitution of some adhesive for polymer may reduce production costs.

Panels in accordance with embodiments of the invention may be produced from sheets of feedstock that are then cut to the desired size by die cutting or other means known in the art. In some embodiments, a feedstock such as paperboard is fed from a feed roll past polymer application devices as are known in the art. The polymer may be, for example, extruded onto the feedstock. The adhesive may be applied over the polymer in the same manner, and the feedstock with polymer and adhesive layers may be rolled back up for transport to other facilities for further processing such as printing, die cutting, and/or production of the final packaging.

Figure 2:
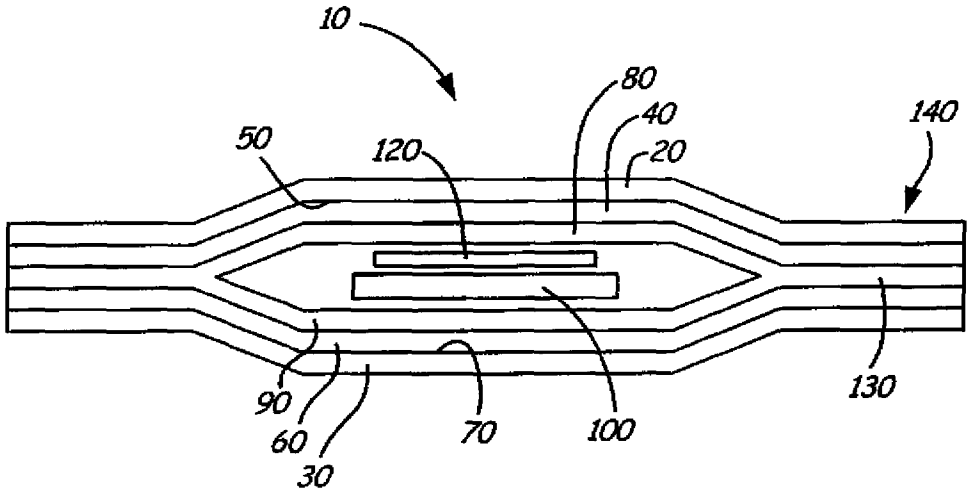
FIG. 2 is a cross section of a secure card package in accordance with embodiments of the invention.

FIG. 2 is a cross section of a secure card package in accordance with embodiments of the invention. The package 10 includes a first panel 20 and a second panel 30. The first panel has a polymeric coating 40 disposed on the inner surface 50 of the panel 20. The second panel 30 also has a polymeric coating 60 on its inner surface 70. An adhesive 80 is disposed over the polymeric coating 40 on the first panel, and an adhesive 90 is disposed over the polymeric coating 60 that is disposed on the second panel. A card 100 is disposed between the first and second panels. Additional enclosures 120, such as instructions or terms and conditions for the use of the card may also be included in the package. More than one card could also be included depending on the application. In FIG. 2, adhesive is shown as being disposed substantially over the entire surface of both panels. For ease of manufacturing this might be a typical case, but the adhesive could also be disposed on only one of the panels prior to enclosing the card.

The embodiment of FIG. 2 shows a laminated layer 140 bonding the two panels together in a region around the card 100. The laminated layer has a first polymer layer 40 adjacent the first panel 20, a second polymer layer 60 adjacent the second panel 30, and an adhesive layer 130 between the first and second polymer layers. The layers of the laminate may not be as distinct as is shown in FIG. 2 due to mixing and intermingling that occur during the bonding process.

Card packages constructed in this fashion may be extremely secure because the combination of polymeric layers and adhesive layers creates a bond with the material that is difficult to infiltrate without irreparably damaging the panel. In cases where the panels include a paperboard substrate, the polymeric layer includes polyethylene, and the adhesive includes ethylene vinyl acetate, among others, the enclosure can be so robust that it is virtually impossible to remove the card from the package without irreparably damaging one or both of the panels. This construction effectively prevents thieves from slicing the package apart at the interface between the panels, removing the card to acquire data from the card, and returning the card to the package for sale to an unsuspecting customer. In some cases a narrow strip of tensilized polypropylene or other filament may be pre-applied to either panel of the package. Such a filament is commonly used in express mail envelopes such as those used by Federal Express® to allow easier opening of the envelopes. This allows the consumer to open the package without the need for scissors. It opens the package cleanly, yet does enough damage to insure tamper evidence.

Figure 3:
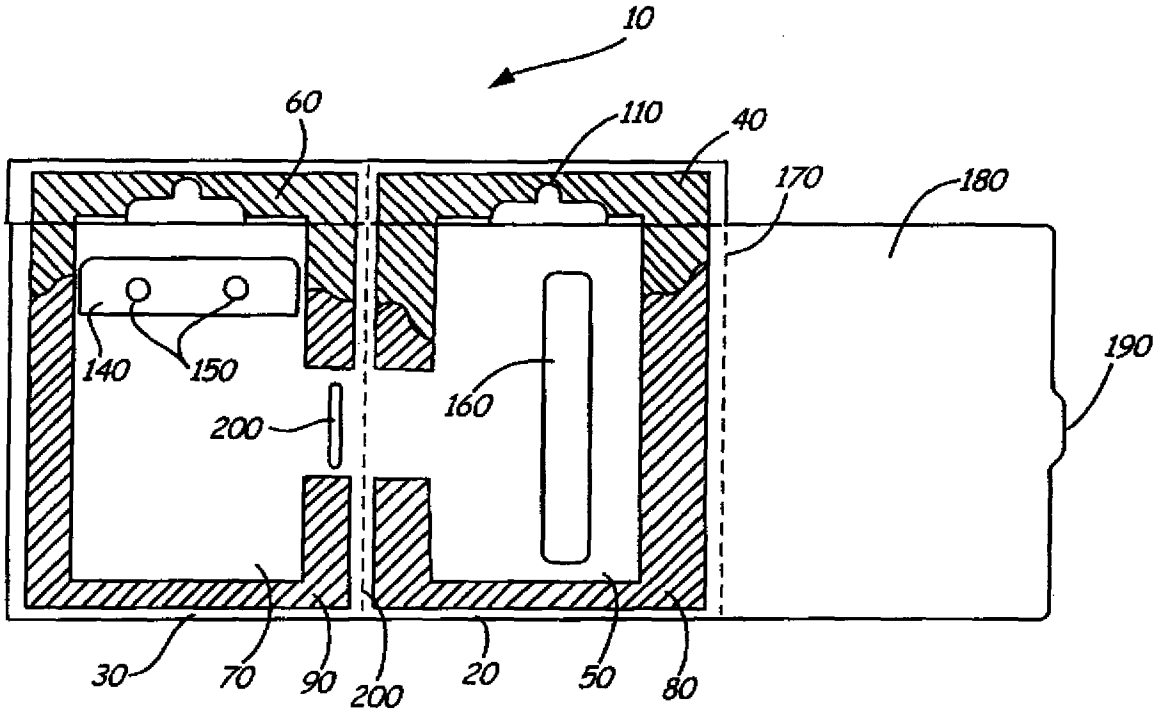
FIG. 3 is a modified plan view of a secure card package in accordance with embodiments of the invention.

FIG. 3 is a modified plan view of a secure card package in accordance with embodiments of the invention. The secure card package shown in FIG. 3 is capable of holding one or more cards and/or documents between a first panel 20 and a second panel 30. The first panel 20 has a polymeric layer 40 disposed thereon. An adhesive layer 80 is disposed over the polymeric layer. In FIG. 3, a portion of the adhesive layer 80 is removed to expose the polymeric layer 40. The polymeric layer 40 and adhesive layer 80 are shown as disposed generally around a central area of the first panel 20 and near the perimeter of the first panel 20. This arrangement is merely one example, and the polymeric layer 40 and adhesive layer 80 could cover essentially the entire first panel 20 or any appropriate portion thereof. Similarly, a polymeric layer 60 and adhesive layer 90 are located on second panel 30.

To form the secure card package from the elements shown in FIG. 3, a card and/or other material may be placed between the first 20 and second 30 panels, with the first 20 and second 30 panels oriented so that their inner surfaces 50, 70 are facing each other. The panels may then be pressed together and heated to form a laminated layer bonding the two panels together in a region around the card and/or other material. The laminated layer is formed from the first polymer layer 40 adjacent the first panel 20, the second polymer layer 60 adjacent the second panel 30, and adhesive layer between the first and second polymer layers formed from the adhesive layers 80 and 90.

The embodiment in FIG. 3 also includes an aperture 160 in the first panel 10. In some instances, the card or other contents of the package (not shown) may include a data field of human- and/or machine-readable data. In cases where a card is used as a stored value card, the data field may be used to activate an account associated with the card. The card or other contents may be disposed so that the data field can be viewed through the aperture 160 without removing the contents from the package. A similar aperture could be used with any of the embodiments described herein or covered by the claims below.

The embodiment of FIG. 3 includes a third panel 180 with at least one edge. The at least one edge of the third panel is joined to at least one edge of the first panel at junction 170. Junction 170 may be a fold line formed in a single sheet of material, but the panels may, be joined in any manner known in the art.

The third panel 180 is adapted to move through a range of motion even while the first 20 and second 30 panels are fastened together to enclose the card and/or other contents of the package. This range of motion includes a first position wherein the third 180 panel at least partially covers the first panel 20. The panels may be joined so that the third panel 180 can rotate or move about an axis coaxial with the junction 170. When the third panel 180 is in this first position, the first panel 20 is disposed generally between the second 30 and third 180 panels. In some embodiments that include the aperture 16, the third panel 180 may cover the aperture when in the first position of the range of motion.

The third panel 180 may also be moved to a second position. In this second position the third panel 180 at least partially covers the second panel 30, the second panel 30 being disposed between the first 20 and third 180 panels when in the second position.

In some embodiments, the third panel 180 can be secured to either or both the first and second positions by any suitable fastener known in the art. FIG. 3 shows a tab 190 and a slot 200 may cooperate to hold the third panel 180 in this second position. In another embodiment, a releasable adhesive can be disposed on the second panel 30 and/or the third panel 180 for fastening the panels together in the second position. In yet another embodiment, the third panel 180 can first be held to the second panel by a releasable adhesive, and then refastened to the second panel at a later time with the slot 200 and tab 190 depicted in FIGS. 1 and 2. In some embodiments, the third panel 180 can be similarly secured against the back surface of first panel 20 using any of these or other known fasteners.

The three panels of the embodiment shown in FIG. 3 may be formed from a unitary sheet of material. This sheet has a first fold line 200 and a second fold line at junction 170, wherein the first 20, second 30, and third 180 panels are formed on the sheet with the first 20 and second 30 panels joined at the first fold line 200 and the first 20 and third 180 panels joined at the second fold line at junction 170.

The movement of the third panel 180 can advantageously add to the aesthetics, functionality, and/or security of the package assembly 10. For example, in one embodiment, the third panel 180 can be fastened against the second panel 30 with a non-resealable adhesive, thus making an attempt to access the card by lifting the third panel detectable. In another embodiment, a retailer or other person may detach the removable portion 140 of the second panel 30 in order to access and activate the card. After the card has been activated, it can be placed back through the slot created by the removable portion 140, and the third panel 180 can be fastened against the second panel 30. Thus, the third panel can conceal the separated line and/or the removed portion and maintain a pleasing appearance when the package is presented to a recipient, while the separation of the removable portion 140 from the second panel 30 creates a difficult to mask indicator that the contents have been removed from the package.

In some embodiments, a supplier or retailer can include indicia on the second panel 30 which can be concealed at appropriate times by the third panel 180. For example, a retailer may desire to include promotional indicia, advertising, instructional indicia or other indicia on the second panel 30 and yet desire to conceal that indicia at times. The third panel 180 can be fastened in the first position against the first panel 20 in order to facilitate viewing of the second panel, and then unfastened and moved into the second position and fastened to the second panel 30 as previously described in order to conceal any indicia on the second panel 30. Indicia placed on the first panel 20 can similarly be concealed by moving the third panel 180 from the second position into the first position against the first panel 20. In addition, some embodiments include indicia on the third panel 180 that can alternately be viewed or concealed depending upon which surface of the third panel the indicia is on.

Figure 4:
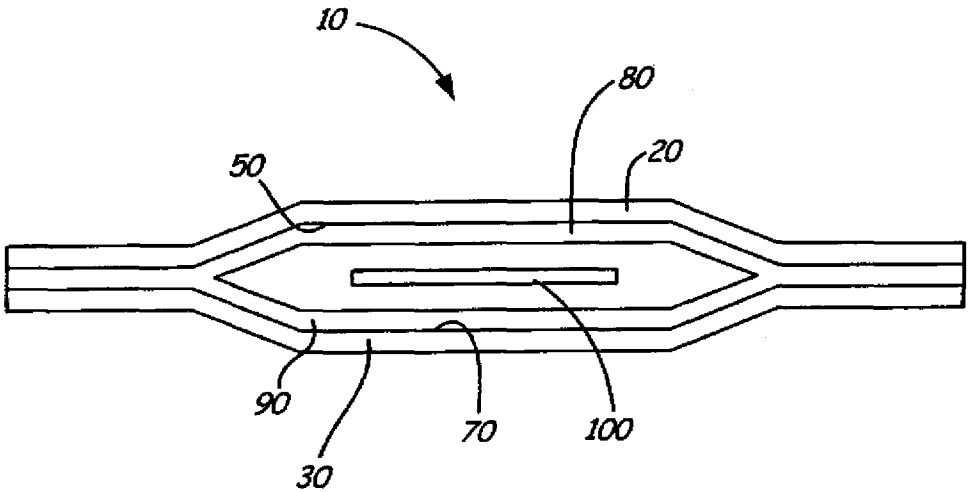
FIG. 4 is a cross section of a secure card package in accordance with the invention.

FIG. 4 is a cross section of a secure card package in accordance with the invention. The package 10 includes a first panel 20 and a second panel 30. The first panel has an adhesive 80 disposed on the inner surface 50 of the panel 20. The second panel 30 also has an adhesive 90 on its inner surface 70. In FIG. 4, adhesive 80, 90 is shown as being disposed initially on both panels 20, 30. For ease of manufacturing this might be a typical case, but the adhesive could also be disposed on only one of the panels prior to enclosing the card.

A card 100 is disposed between the first and second panels. The card could be a stored value card or other card where security of the card is an issue. The package may also include documentation as to how to use the card or redeem card value as well as terms and conditions regarding the card agreement or other documentation (not shown).

The panels could be any suitable paper board or plastic stock, but one embodiment uses solid bleached sulfate paper stock that is clay coated on both sides (C2S SBS), or a similar coated board stock. The adhesive is a heat activated adhesive and is applied directly to the clay coated inner surfaces. The adhesive may be applied to substantially all of the inner surface 50, 70 of the panels 20, 30 in selected areas. The embodiment of FIG. 4 can produce similar packages to the embodiments of FIGS. 1-3, but without the polymeric layers described above.

The heat activated adhesive of FIG. 4 is more properly described as a coating than a glue. One suitable coatings is Coatings & Adhesives' 204 Heat Seal coating (polyurethane) available from Coating and Adhesives Corporation of Leland, N.C. The adhesive is applied using known printing techniques such as a printing roller, a flood coater, a Gravure press, Anilox roller plates, or analogous techniques. By contrast, glues in automated systems are usually applied by squirt nozzles and spread by pressure rollers. Where the heat activated adhesives can be applied in virtually any pattern that printing ink can be applied, glue can be applied in a line along the direction of travel of a feedstock or as a dot. To apply a line of glue to a package transverse to the line of travel of a feedstock, a line of dots must be applied from a row of nozzles turning on and off quickly.

The heat activated adhesives used in these embodiments are applied to the cardstock in the normal printing process and allowed to dry to be activated later. Glues, by comparison, are applied as part of the package assembly with the card 10 and other components because the assembly has to take place before the glue has an opportunity to dry. The heat activated adhesive can be applied to the entire surface of the panel, and only activated selectively by heating only the portions of the panels that are to be bonded. With glues, care must be taken to avoid allowing the glue to contact the package contents and adhere to them. This fact, combined with the above-discussed ease of controlled application of the heat activated adhesives provide for more efficient production of packages and lower reject rates.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A method for producing a secure card package containing a point-of-sale activatable card, comprising:

providing a first panel and a second panel each comprising paper stock and having a non-polymeric coated inner surface;

printing a heat-activatable adhesive directly upon the non-polymeric coated inner surface of the first panel;

allowing the heat-activatable adhesive to dry upon the non-polymeric coated inner surface of the first panel;

locating a point-of-sale activatable card between the inner surface of the first panel and an inner surface of the second panel, after the step of allowing the heat-activatable adhesive to dry upon the non-polymeric coated inner surface of the first panel; and, activating the heat-activatable adhesive, after the locating step, by applying heat and pressure only in a region substantially surrounding and offset from the point-of-sale activatable card to enclose the point-of-sale activatable card in a secure space between the first and second panels.

2. A method as recited in claim 1, wherein the inner surface of the first panel and the inner surface of the second panel are each clay coated.

3. A method as recited in claim 2, wherein each of the first panel and the second panel have a clay coated outer surface.

4. A method as recited in claim 2, wherein the heat-activatable adhesive comprises polyurethane.

5. A method as recited in claim 1, wherein the heat-activatable adhesive comprises polyurethane.

6. A method as recited in claim 1, wherein the heat-activatable adhesive is printed on substantially all of the non-polymeric inner surface of the first panel.

7. A method as recited in claim 1, wherein the printing step further comprises:

printing the heat-activatable adhesive on the non-polymeric coated inner surface of the second panel, wherein the heat-activatable adhesive printed on the inner surface of said second panel is allowed to dry prior to the locating step.

8. A method as recited in claim 7, wherein the heat-activatable adhesive is printed on substantially all of the non-polymeric coated inner surface of the first panel and on substantially all of the non-polymeric coated inner surface of the second panel.

9. A method as recited in claim 7, wherein the printing step is completed utilizing at least one of a printing roller, a flood coater, a gravure press, and an anilox roller plate.

10. A method as recited in claim 1, further comprising:

applying a filament strip to one of the first panel and the second panel prior to the locating and activating steps, wherein the filament is utilizable to access the secure space.

11. A method as recited in claim 1, wherein the printing step comprises:

applying the heat-activatable adhesive in a predetermined pattern on the inner surface of the first panel.

12. A method as recited in claim 1, wherein said printing step is completed utilizing a printing roller.

13. A method as recited in claim 1, wherein said printing step is completed utilizing a flood coater.

14. A method as recited in claim 1, wherein said printing step is completed utilizing a gravure press.

15. A method as recited in claim 1, wherein said printing step is completed utilizing an anilox roller plate.

16. A method as recited in claim 1, wherein the locating step further comprising:

disposing documentation comprising information relating to the point-of-sale activatable card between the inner surface of the first panel and the inner surface of the second panel, after the allowing step.

17. A method as recited in claim 1, wherein the heat-activated adhesive is disposed only in the region substantially surrounding and offset from the point-of-sale activatable card.

18. A method for producing a secure card package containing a point-of-sale activatable card, comprising:

providing a first panel and a second panel each comprising paper stock and each having a clay coated inner surface and a clay coated outer surface;

printing a heat-activatable adhesive comprising polyurethane directly upon the clay coated inner surface of the first panel;

allowing the heat-activatable adhesive to dry upon the clay inner surface of the first panel;

locating a point-of-sale activatable card between the inner surface of the first panel and the inner surface of the second panel, after the step of allowing the heat-activatable adhesive to dry upon the coated inner surface of the first panel; and, activating the heat-activatable adhesive, after the locating step, by applying heat and pressure only in a region substantially surrounding and offset from the point-of-sale activatable card to enclose the point-of-sale activatable card in a secure space between the first and second panels.

19. A method as recited in claim 18, wherein the heat-activatable adhesive is printed on substantially all of the inner surface of the first panel.

20. A method as recited in claim 19, wherein the printing step is completed utilizing an anilox roller plate.

21. A method as recited in claim 20, wherein the printing step further comprises:

printing the heat-activatable adhesive on substantially all of the clay inner surface of the second panel, wherein the heat-activatable adhesive printed on the inner surface of said second panel is allowed to dry prior to the locating step.

22. A method as recited in claim 1, wherein said secure card package comprises:

a data field.

23. A method as recited in claim 22, wherein one of said first panel and said second panel includes an aperture, and wherein said data field is provided on said point-of-sale activatable card so that at least a portion of the data field is viewable through the aperture.

24. A method as recited in claim 23, wherein said data field includes machine-readable data.

25. A method as recited in claim 23, wherein said data field includes machine-readable data.

26. A method as recited in claim 23, wherein said data field includes machine-readable data for use in activating an account associated with the card.

27. A method as recited in claim 23, wherein said secure card package includes another aperture for hanging on a display rack, and wherein a long edge of the secure card package extends away from the aperture.

28. A method as recited in claim 27, wherein a long edge of said card extends along a long edge of the secure card package.

29. A method as recited in claim 28, further comprising:

applying a filament strip to one of the first panel and the second panel prior to the locating and activating steps, wherein the filament is utilizable to access the secure space.

30. A method as recited in claim 22, wherein one of said first panel and said second panel includes an aperture, and wherein said data field is a machine-readable activation data field provided on said point-of-sale activatable card so that the data field is viewable through the aperture for use in activating an account associated with the card.

* * * * *